United States Patent [19]

Schnell

[11] 4,240,591

[45] Dec. 23, 1980

[54] MINCER WITH AT LEAST ONE ROTARY MINCING TOOL

[76] Inventor: Karl Schnell, Mühlstrasse 28, D-7065 Winterbach, Fed. Rep. of Germany

[21] Appl. No.: 51,137

[22] Filed: Jun. 22, 1979

[30] Foreign Application Priority Data

Jun. 22, 1978 [DE] Fed. Rep. of Germany ..... 2827369

[51] Int. Cl.[3] ..... B02C 18/30

[52] U.S. Cl. ..... 241/82.4; 241/82.5; 241/82.7

[58] Field of Search ..... 241/82.4, 82.5, 82.6, 241/82.7; 425/197–199

[56] References Cited

U.S. PATENT DOCUMENTS

| | | | |
|---|---|---|---|
| 643,547 | 2/1900 | Smith | 241/82.6 |
| 3,847,360 | 11/1974 | Seydelmann | 241/82.7 X |
| 4,153,208 | 5/1979 | Vomhof et al. | 241/82.7 X |

*Primary Examiner*—Mark Rosenbaum

*Attorney, Agent, or Firm*—McGlew and Tuttle

[57] ABSTRACT

A mincing machine comprises a housing having an inlet for the material to be minced and a discharge for the minced material includes a mincing passage between the inlet and the discharge with a rotatable shaft therein having at least one rotatable mincing tool affixed thereto for rotation therewith in the mincing passage and including a centrifugal disc affixed to the shaft for rotation therewith at the entrance to the mincing passage which has a peripheral portion with a respective groove for collecting hard objects before they move into the mincing passage. The groove advantageously comprises an annular trough-shaped formation of the disc which includes an outer radial rim portion at the front end of the passage and a wall facing toward the mincing tools having a plurality of apertures therein through which the material passes for mincing. The annular groove of the disc receives any hard materials by the centrifugal action of the rotation of the disc and prevents their movement into the mincing passage where they might damage the mincing tool.

5 Claims, 1 Drawing Figure

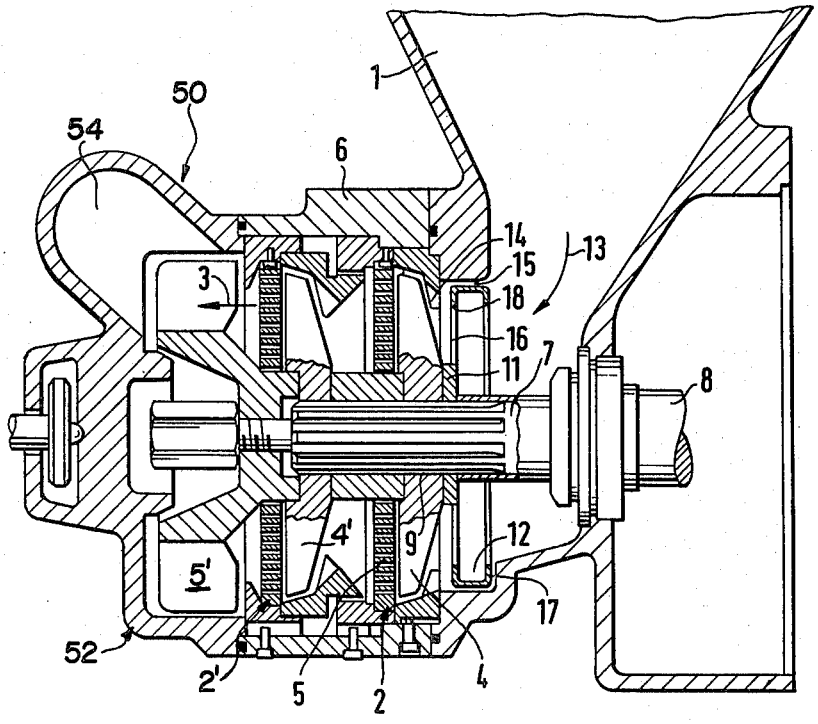
1
50
54
6
14
15
13
3
18
16
11
7
8
4'
9'
12
5'
17
52
2'
5
2
4

MINCER WITH AT LEAST ONE ROTARY MINCING TOOL

BACKGROUND OF THE INVENTION

1. Field of the Invention

This invention relates, in general, to devices for cutting materials into smaller forms and, in particular, to a new and useful mincing machine which includes one or more sets of rotatable cutting tools in the form of a rotatable cutting knife and a perforated disc and to an improved centrifugal disc which has a peripheral groove for entrapping hard objects before they move into the mincing compartment.

The invention relates to a mincing machine equipped with at least one mincing tool. Such machines are frequently employed in the food industry, particularly the meat processing industry. The material to be minced, for example, meat and/or meat by-products, is fed usually through a chopper into the mincing machine where it is minced in one or several stages. It may happen that hard objects, for example, coins, screws from some auxiliary equipment, hooks, etc., pass into the machine along with the processed material.

SUMMARY OF THE INVENTION

The invention is directed to a mincing machine equipped with at least one rotary mincing tool, permitting to remove such undesirable, hard foreign objects from the processed material, so that they are prevented from being discharged along with the material.

In accordance with the invention, a mincing device includes a housing which has an inlet leading into a mincing compartment in which are located one or more sets of rotating mincing tools. The mincing tools are contained on a rotatable shaft which, in accordance with the invention, is also provided with a rotatable centrifugal disc which has an annular groove into which relatively hard objects pass before they can move into the mincing compartment. The disc also has a wall facing the mincing compartment which has a plurality of apertures therein through which the material to be minced is passed.

The centrifugal disc rotates, due to its fixed connection, to the driving shaft of the mincing tool, at the same, preferably high, speed as the tool. In consequence, the material to be minced is set in rotation as soon as it arrives into the range of operation of the centrifugal disc. Because of the centrifugal force, the heavier parts, for example, metallic objects, etc., which may be mixed to the processed material, are centrifuged to the outside and pass into the catching groove of the disc. The lighter material to be minced passes through the apertures in the centrifugal disc into the range of action of the mincing tool or the following cutting or chopping set. As a rule, this set comprises a knife, particularly a tow-blade knife, and a perforated disc.

In a particularly preferred embodiment of the invention, the centrifugal disc is provided in advance of the mincing tool or of the first mincing tool, considered in the feed direction of the processed material, so that the objects which may be mixed to this material are removed before they would pass to the mincing tool or first mincing tool. This securely eliminates damages of the mincing or cutting tool or tools, and, if provided, also of the so-called baffle fingers located in advance of the mincing tool, considered in the feed direction. In this case, it is assumed that the material to be minced reaches the centrifugal disc before it arrives to the baffle fingers. As soon as the processed material has been discharged from the mincing machines and the machine is stopped, the centrifugal disc is stopped too and the metallic objects, etc., which may remain imbedded in a residual amount of the processed material can be removed.

In accordance with a development of the invention, the catching groove is provided at the outer rim of the centrifugal disc. This outer rim may be so closely spaced from the surrounding housing part that the processed material and, particularly, the foreign objects are prevented from passing by the centrifugal disc outwardly. In a further development of the invention, it is provided that the catching groove is formed on the centrifugal disc, especially formed by the bent circumferential rim portion of the disc. Advantageously, the centrifugal disc and the drive shafts are connected to each other by a splined shaft connection or the like, which facilitates the assembly and reliably insures the force transmission.

Accordingly, it is an object of the invention to provide a mincing tool which includes one or more mincing tool sets arranged in a mincing passage between an inlet and discharge of the machine and with a rotatable centrifugal disc which has a peripheral groove for trapping materials disposed at the entrance to the mincing path which has one more apertures therein for the passage of the material to be minced.

A further object of the invention is to provide a mincing tool which is simple in design, rugged in construction and economical to manufacture.

For an understanding of the principles of the invention, reference is made to the following description of typical embodiments thereof as illustrated in the accompanying drawings.

GENERAL DESCRIPTION OF THE PREFERRED EMBODIMENT

Referring to the drawings, in particular, the invention embodied therein comprises a mincing machine generally designated 50 which includes a housing 52 having an inlet 1 in the form of a hopper into which material to be minced is directed. The material to be minced moves in the direction of the arrow 13 from the inlet 1 to a mincing passage which contains one or more mincing tools, such as a rotatable knife 4 and a perforated disc 5 which are mounted on a shaft 7 for rotation of the mincing passage. After mincing, the materials which are minced, are passed in the direction of the arrow 3 to a discharge 54.

The machine comprises an inlet 1 which, preferably, is hopper-shaped and through which the material to be minced is passed, the material may include some hard objects to be removed by means of the inventive arrangement, all of which pass into the interior of the machine. The material is minced by at least one cutting tool set 2, arranged either in one or several stages. The minced material leaves the machine in the direction of arrow 3. The single cutting set 2 or, in the shown embodiment, each of the several cutting sets 2 and 2' comprises a rotary, preferably two-blade cutting knife 4, (4') and a perforated disc 5, (5'). These discs 5 and 5' are supported in the housing 6 of the machine and fixed axially and radially. Each cutting knife 5 (5') is non-rotatably coupled to a drive shaft 7 having a drive end 8 (shown partly) which is non-rotatably connected to a drive motor (not shown). Cutting knife 4 and drive shaft 7 are connected to each other through a splined portion 9 of the shaft.

In accordance with the invention, splined shaft 7 carries a centrifugal disc 11 which is provided with a catching groove 12 in the form of an annular trough. The disc 11 is secured against rotation and displacement relative to the shaft 7. Considered in the feed direction, centrifugal disc 11 is provided in advance of cutting set 2 or cutting knife 4, and also of so-called baffle fingers 14. Since hard objects undesirably taken along with the material to be minced can be separated due to the provided centrifugal disc 11, both baffle fingers 14 and the cutting sets 2 and 2' are well protected against being damaged by such objects.

Catching groove 12 extends along the outer rim of centrifugal disc 11 and, preferably, is formed thereon. In practice, nothing can pass through the narrow gap 15 since it is dimensioned to prevent such a passage of any material. Consequently, the material to be minced must pass through apertures 16 which are provided in centrifugal disc 11. These apertures 16 are relatively large and the disc has only relatively narrow separating webs, in the shape of spokes, remaining therebetween. The cross-sectional area of the passage to the cutting sets 2 and 2' is thus only negligibly reduced by the provided centrifugal disc 11.

Advantageously, the disc rim radial portion 17 facing in the direction of the incoming material extends inwardly somewhat beyond the outer edge 18 of apertures 16.

While a specific embodiment of the invention has been shown and described in detail to illustrate the application of the principles of the invention, it will be understood that the invention may be embodied otherwise without departing from such principles.

What is claimed is:

1. In a mincing machine comprising a housing having an inlet for the material to be minced and a discharge for the minced material, and a mincing passage between the inlet and the discharge and having a rotatable shaft therein with at least one rotatable mincing tool affixed thereto for rotation therewith in the mincing passage, the improvement comprising a centrifugal disc affixed to the shaft for rotation therewith adjacent said inlet and in said mincing passage before said at least one mincing tool and having an annular peripheral portion with inturned radially extending end portions at each end defining with said peripheral portion an annular receiving groove for collecting hard objects therein before they move into said mincing passage and having a passage extending axially therethrough for the materials which are to be minced.

2. In a mincing machine according to claim 1, wherein said centrifugal disc has a plurality of openings therein comprising said mincing passage for the materials to be minced, said receiving groove extending around the periphery of said centrifugal disc and extending axially of said shaft.

3. In a mincing machine according to claim 1, wherein said at least one rotatable mincing tool comprises a plurality of sets of tools including a mincing cutting knife and a perforated disc in each set.

4. In a mincing tool according to claim 3, wherein said centrifugal disc includes an outer rim with a perforated rear wall defining said passage from said inlet to said mincing passage and a partial radial wall extending inwardly from the outer end of said rim, the receiving groove being defined between said rim and the rear wall of said disc.

5. In a mincing machine according to claim 1, wherein said shaft includes a splined portion, each of said mincing tools having a splined connection to said shaft for rotation therewith, said centrifugal disc including an outer peripheral rim portion spaced closely to said housing and having a radially extending outer inturned portion adjacent said inlet, the material to be minced passing within the inner edge of said rim portion, said disc having a wall portion with a plurality of radial spokes defining apertures therebetween defining the passage from said inlet into said mincing passage.

* * * * *